US005664586A

United States Patent [19]

Sinclair et al.

[11] Patent Number: 5,664,586

[45] Date of Patent: Sep. 9, 1997

[54] TOBACCO SMOKE FILTERS AND FILTER RODS THEREFOR

[75] Inventors: Neil Murray Sinclair, Danbury; Robert Kinsey Dart, Loughborough, both of United Kingdom

[73] Assignee: Rothmans International Services Limited, London, Great Britain

[21] Appl. No.: 495,420

[22] PCT Filed: Jan. 17, 1994

[86] PCT No.: PCT/GB94/00086

§ 371 Date: Jun. 30, 1995

§ 102(e) Date: Jun. 30, 1995

[87] PCT Pub. No.: WO94/16581

PCT Pub. Date: Aug. 4, 1994

[30] Foreign Application Priority Data

Jan. 19, 1993 [GB] United Kingdom ..... 9300901

[51] Int. Cl.[6] ..... A24D 3/00

[52] U.S. Cl. ..... 131/331; 131/340; 131/342; 493/42

[58] Field of Search ..... 131/331, 332, 131/340, 345, 361, 342; 428/370, 398

[56] References Cited

U.S. PATENT DOCUMENTS

| | | | |
|---|---|---|---|
| 3,063,951 | 11/1962 | Schouleden | 131/332 |
| 4,022,704 | 5/1977 | Morie et al. | 260/29.2 |
| 4,546,040 | 10/1985 | Knotek et al. | 131/332 |
| 4,605,401 | 8/1986 | Chmelir et al. | 604/368 |
| 5,497,793 | 3/1996 | Kubich | 131/331 |

FOREIGN PATENT DOCUMENTS

| | | | |
|---|---|---|---|
| 972530 | 5/1985 | France | 131/331 |
| 3 313 344 | 6/1982 | Germany | 131/331 |
| 5227939 | 10/1984 | Japan | 131/331 |
| 52140482 | 9/1996 | Japan | 131/331 |

*Primary Examiner*—Vincent Millin
*Assistant Examiner*—Charles W. Anderson

[57] ABSTRACT

The invention provides a cigarette filter (1) the biodegradation of the material (3) which is assisted by the incorporation of swellable means in the filter so that upon exposure to moisture the volume of the filter is increased, preferably to the extent of breaking open a filter wrap (2) which enclosed it.

9 Claims, 1 Drawing Sheet

TOBACCO SMOKE FILTERS AND FILTER RODS THEREFOR

This invention relates to tobacco smoke filters and filter rods therefor, and is intended to provide a filter which is more environmentally friendly.

According to the present invention a tobacco smoke filter or filter rod is provided with means which cause it to expand when it becomes moist to increase the surface area of filter material exposed to the environment.

Thus, the discarded butt of a filter tip will expand when it rains thus causing it to expose a bigger area of filter material to the environment, preferably by opening up. This process will enhance the rate of biodegradation of the filter material by natural processes in the environment and by naturally occurring organisms.

In a preferred construction the means causing the expansion are provided by a substance which expands upon absorption of moisture being incorporated within the filter or rod.

The construction can be arranged so that when the filter or rod expands upon absorption of moisture by the substance, the cigarette tipping paper (i.e. the wrapping which surrounds the filter in the made-up cigarette) is broken open.

Various substances can be used, for example polyacrylates, polyacrylamides and polysaccharides, the latter including chitin, agar or cellulose derivatives.

The substances can be incorporated in various ways, for example, the substance can be incorporated into the material from which the filter is made. Thus, the material can be incorporated into tow during manufacture thereof.

Again, the substance could be added during construction of the filter or the filter rod, for example by adding the substance as a paste or suspension with a plasticiser, or it could be applied to the tow or web as a paste or suspension as part of a separate process during filter manufacture. Another alternative method of incorporating the substance is to apply it to the tow or web as a dry powder during manufacture of the filter or of the rod.

A rod incorporating the substance is then cut to length for incorporation in a filter in the usual way.

If desired the substance can be added to the filter by incorporating it within a discrete compartment in the filter, such as a longitudinal cavity in the made-up filter or, if the filter is of a multiple type, in a cavity between two segments of filter material.

The filter materials can be various kinds, for example tow or web formed from cellulose acetate, paper, cellophane, biodegradable polyester or a combination of two or more of these.

The invention also includes a filter smoking article of which the filter is provided with means to cause it to expand when it becomes moist.

The invention can be performed in various ways and three embodiments will now be described by way of example and with reference to the accompanying drawings in which.

Figure 1:
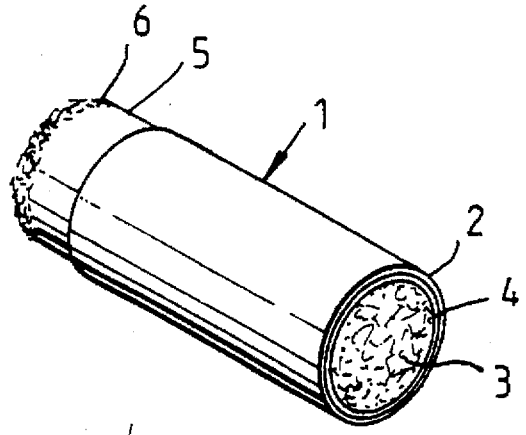
FIG. 1 is an isometric diagrammatic view of a cigarette end with a dry filter tip in which a substance to cause it to expand when wet is incorporated into the material from which it is made.

As shown in FIG. 1 a cigarette end incorporating the invention has a filter tip indicated by reference numeral 1 and comprises an outer cigarette tipping paper 2 which unites the filter tip 1 to a tobacco rod 5 to form a cigarette. Filter material 3 encased by a plugwrap 4 is made from a tow or web to which a substance has been added as a dry powder during manufacture of the filter. The substance which has been added expands when wet and can, for example, be a polyacrylamide or a polysaccharide, including chitin, agar or cellulose derivatives.

Alternatively the substance can be added as a paste or suspension with a plasticiser, or be applied to the tow or web as a paste or suspension as part of a separate process during filter manufacture.

FIG. 1 shows the butt of the cigarette after it has been smoked and the tobacco rod 5 has been burned down leaving only ash 6. Although shown in this way it will be appreciated that sometimes a filter tip can become completely disconnected from the tobacco rod after smoking and the butt has been discarded.

Figure 2:
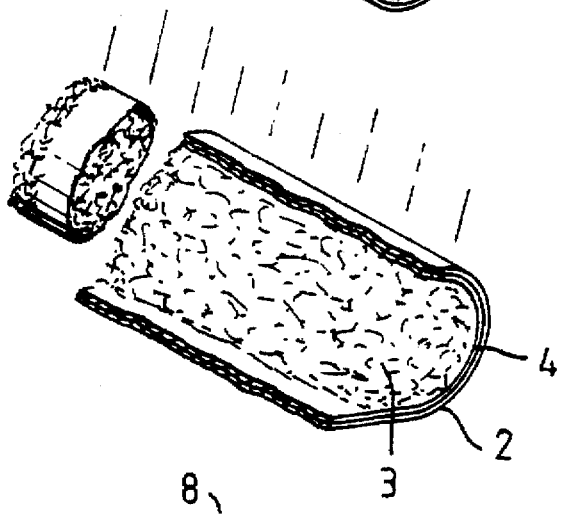
FIG. 2 is a diagrammatic isometric view of the embodiment shown in FIG. 1 when it has been in contact with water.

FIG. 2 shows the effect of moisture, for example in the form of rain, on the discarded butt, due to the moisture soaking through the tipping paper 2 and plugwrap 4 or from the exposed end by capillary action into the filter material. The substance which expands when it becomes wet has been affected and has caused expansion of the filter material sufficiently to break open the tipping paper 2 and plugwrap 4 and expose a greater area of the filter material 3 to the environment thus enhancing the rate of biodegradation of the filter material by natural processes in the environment and by naturally occurring organisms.

Figure 3:
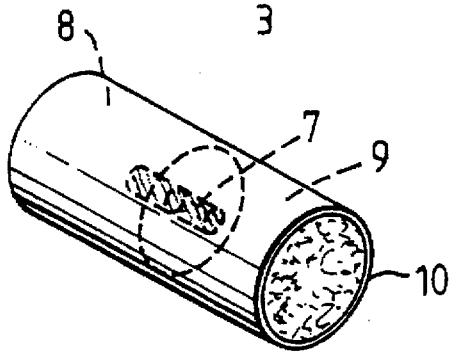
FIG. 3 is an isometric view of another form of filter tip in which the substance which causes it to expand has been added during manufacture of the tip itself.

FIG. 3 shows a construction of a filter tip which is what is usually referred to as a multiple filter and comprises two segments 8 and 9 held together by a plugwrap and overwrapped by a tipping paper 10. The elements are shaped to form a common internal chamber 7 in which is located the substance which expands when it absorbs moisture.

Figure 4:
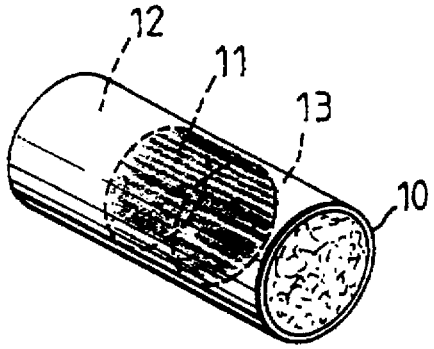
FIG. 4 is an isometric view of another construction according to the invention.

FIG. 4 shows an alternative construction of a multiple filter in which the substance which expands is held in a discrete centre segment 11 held between two segments 12 and 13 of a triple configuration.

In both the above constructions shown in FIGS. 3 and 4 the effect of the substance when moisture soaks into the filter tip is similar to that described with regard to the construction shown in FIGS. 1 and 2.

The invention also includes a smoking article, for example a cigarette or cigar, incorporating a filter tip of the kind set forth above.

EXAMPLE

Filter rods 7.83 mm in diameter were prepared on a conventional filter making machine by drawing, blooming and compressing within 150K plugwrap 1.5Y/46,000 cellulose acetate tow onto which had been applied randomly after blooming a cross-linked polyacrylate polymer in the form of dry granules of average diameter 0.45 mm, sold under the Trade Name Supergel (Chempak Products, Hoddesdon, Hertfordshire, England). The granules were applied at a rate of 48 mg per 120 mm length of filter rod; and the weight of polymer per individual 20 mm filter plug was thus approximately 8 mg.

The rod is encased conventionally in a plugwrap and is cut to length for individual filters.

In other experiments, the amount of polymer per filter ranged from 4 to 80 mg. In no case did the presence of the polymer influence the performance of the filter in removing particulate matter from smoke nor did the passage of smoke through the filter cause detectable swelling of the included polymer.

The filters were conventionally assembled to tobacco rods to form cigarettes. The filter length was 20 mm and the amount of polisher per individual filter was approximately 8 mg. When smoked butts with filters containing polymer were placed in water, swelling of the polymer, leading to expansion and disruption of the filter, took place within fifteen minutes.

In environmental trials in which smoked butts containing polymer were placed on soil and exposed to the weather, swelling of the gel took place within a week of rainfall leading to rupture of the wrapping layers of paper and opening up of the cellulose acetate matrix to the environment.

Finally, the substance can act as a carrier for enzymes or precursors of enzymes which may be immobilized and act to degrade the filter material or to encourage colonization of microorganisms which will degrade it, thus in either case further to accelerate the biodegradation of the filter.

We claim:

1. A tobacco smoke filter or filter rod therefor (hereinafter "filter") comprising a main body portion; expandable means for expanding the main body portion when the expandable means becomes moist, and wrap means for wrapping the main body portion, the expansion of the main body portion being such as to break open the wrap means.

2. A filter according to claim 1 wherein the expandable means is a particulate swellable substance.

3. A filter according to claim 1 wherein the expandable means is a polyacrylate polymer.

4. A filter according to claim 1 wherein the expandable means is a swellable substance distributed throughout main body portion of the filter.

5. A filter according to claim 4 wherein the swellable substance is in particulate form.

6. A filter according to claim 1 wherein the expandable means is a swellable substance contained in a discrete compartment in the filter.

7. A filter according to claim 1 arranged so that the surface area of filter exposed to the environment increases when the expandable means becomes moist.

8. A smoking article incorporating a smoke filter according to claim 1.

9. A cigarette incorporating a smoke filter according to claim 1.

* * * * *